US005706687A

United States Patent [19]

Welsh et al.

[11] Patent Number: 5,706,687

[45] Date of Patent: Jan. 13, 1998

[54] SPRING COILING MACHINE

[75] Inventors: Colin Welsh, Torrington; Todd E. Brink, Farmington, both of Conn.

[73] Assignee: BHS-Torin Inc., Farmington, Conn.

[21] Appl. No.: 543,259

[22] Filed: Oct. 18, 1995

[51] Int. Cl.[6] ..... B21F 3/10; B21F 3/04

[52] U.S. Cl. ..... 72/138; 72/145

[58] Field of Search ..... 72/135, 137, 138, 72/140, 142, 145, 78

[56] References Cited

U.S. PATENT DOCUMENTS

| | | | |
|---|---|---|---|
| 2,276,579 | 3/1942 | Halvorsen et al. | 72/138 |
| 2,765,022 | 10/1956 | Bergevin | 72/138 |
| 4,026,135 | 5/1977 | Yagusic et al. | 72/142 |
| 5,243,746 | 9/1993 | Shinichi | 72/138 |
| 5,363,681 | 11/1994 | Speck et al. | 72/145 |

FOREIGN PATENT DOCUMENTS

| | | | |
|---|---|---|---|
| 2743821 | 4/1979 | Denmark | 72/78 |

*Primary Examiner*—Lowell A. Larson
*Assistant Examiner*—Rodney Butler
*Attorney, Agent, or Firm*—McCormick, Paulding & Huber

[57] ABSTRACT

A spring coiling machine has a rotary feed assembly with a servo motor for driving the feed rolls mounted therein and forming a part thereof. Substantially all tooling including a coiling tool, a pitch tool and an auxiliary arbor are also servo motor operated with three axes of servo control provided for the coiling tool. The auxiliary arbor has a plurality of wire forming positions and is also servo motor controlled.

32 Claims, 12 Drawing Sheets

SPRING COILING MACHINE

BACKGROUND OF THE INVENTION

The present invention relates to an improved spring coiling machine of the general type which is adapted for the intermittent feeding of predetermined lengths of wire, the lengths of wire being coiled during feeding to form springs and the wire being cut off on completion of coiling. While not necessarily so limited, the invention is particularly applicable in spring coiling and winding machines of the type shown and described in:

U.S. Pat. No. 2,119,002, issued May 31, 1938 to Bergevin and Nigro.

U.S. Pat. No. 2,455,863, issued Dec. 7, 1948 to E. W. Hakvorsen.

U.S. Pat. No. 2,820,505, issued Jan. 21, 1958 to E. E. Franks et al.

U.S. Pat. No. RE24,345, issued Aug. 20, 1957 to C. R. Bergevin.

U.S. Pat. No. 2,902,079, issued Sep. 1, 1959 to Costello et al.

U.S. Pat. No. 2,923,343, issued Feb. 2, 1960 to Franks.

U.S. Pat. No. 2,925,115, issued Feb. 16, 1960 to Franks.

U.S. Pat. No. 3,009,505, issued Nov. 21, 1961 to Franks.

U.S. Pat. No. 3,068,927, issued Dec. 18, 1862 to Bergevin,

U.S. Pat. No. 3,402,584, issued Sep. 24, 1968 to Cavagnero.

U.S. Pat. No. 3,934,445, issued Jan. 27, 1976 to Lampietti.

U.S. Pat. No. 4,018,071, issued Apr. 19, 1977 to Yagusic et al.

U.S. Pat. No. 4,018,070, issued Apr. 19, 1977 to Lampietti.

U.S. Pat. No. 4,026,135, issued May 31, 1977 to Yagusic et al.

U.S. Pat. No. 4,030,327, issued Jun. 21, 1977 to Collins et al.

U.S. Pat. No. 4,387,585, issued Jun. 14, 1983 to Cavagnero et al.

U.S. Pat. No. 4,520,644, issued Jun. 4, 1985 to Lampietti.

U.S. Pat. No. 5,363,681, issued Nov. 15, 1994 to Speck et al.

More particularly, the invention relates to a spring coiling machine wherein wire feed, diameter, pitch, torsion and other coiling tool movements are effected directly with externally commutated AC brushless servo motors under the control of a microprocessor or the like. Further, provision is made for the rotation of conventional feed rolls during spring formation under the control of a servo motor. Still further, an auxiliary arbor is provided and is moveable under the control of a servo motor for precise positioning in a variety of bending operations effected on end portions of springs and the like.

It is the general object of the present invention to provide a spring coiling machine which exhibits the ultimate in flexibility with seven (7) different tool or element movements or "axes" under the control of servo motors in turn controlled by a microprocessor or the like.

A further object of the invention involves the provision of a rotary feed roll assembly wherein a servo motor for driving the feed rolls forms a part of the assembly for rotation therewith and for enhanced accuracy and efficiency in operation.

A still further object of the invention resides in the provision of an auxiliary arbor adapted for servo motor control in providing a variety of bending operations on end portions of coil springs and the like.

SUMMARY OF THE INVENTION

In fulfillment of the foregoing objects, a cyclically operable spring coiling or wire forming machine having a coiling station is provided with a feed roll assembly which comprises at least one pair of oppositely rotatable feed rolls for cooperatively gripping wire therebetween and for advancing the same longitudinally to the coiling or forming station. A relatively fixed coiling arbor may be provided at the coiling station and has at least one associated coiling tool which is arranged to engage longitudinally advancing wire and to obstruct the linear movement thereof whereby progressively to bend the same about the coiling arbor and thus impart a coiling stress thereto resulting in the formation of a coil spring at a leading end portion thereof. A cutting tool at the coiling station adjacent the coiling arbor operates to intermittently sever coiled leading end portions of the wire whereby to provide individual coil springs or other formed wire products.

The aforementioned feed roll assembly is mounted for rotation about the axis of wire advanced by the feed rolls with a servo motor driving at least one of the feed rolls and which is supported by and rotatable with the feed roll assembly. This avoids the complexity of driving the feed rolls from a stationary external source of power and enhances the accuracy and efficiency of the wire feeding operation. A stationary servo motor for bodily rotating the feed roll assembly is provided and operates in timed relationship with the advancement of the wire by the feed rolls and the formation of coil springs or other formed wire articles.

Preferably, the feed roll assembly is rotatable through 360° with provision made for rotation in one in an opposite direction from a mid point, rotation in each direction being available through 180°.

As is conventional, a fluid cylinder means is provided in operative association with at least one of the feed rolls for urging the same in a direction generally perpendicular to the line of wire feed and toward the other feed roll, the fluid cylinder thus being operable selectively to cause the feed rolls to grip and release wire extending therebetween. The fluid cylinder means is also supported by and rotated with the feed roll assembly.

Preferably, and as is conventional, two (2) pairs of feed rolls are provided in adjacent relationship with at least one roll of each pair being driven by the servo motor and with at least one roll of each pair having an associated fluid cylinder means for urging the same in a generally perpendicular direction relative to the line of wire feed for gripping and releasing wire. As shown and described hereinbelow, a gear means is provided in association with the servo motor whereby to provide for the driving relationship of all four feed rolls in unison from the servo motor with opposing feed rolls rotating in opposite directions. At least one guide means is also provided for the passage of wire therethrough in association with the feed rolls.

In providing the flexibility mentioned above, the coiling tool is mounted for movement along an "axis" generally toward and away from the coiling arbor and substantially along a forwardly extended wire feed line. A servo motor for controlling the movement of the coiling tool during formation of a coil spring or other formed wire article may be under the control of a microprocessor or the like.

A pitch tool is also provided at the coiling station and may be substantially conventional in operation, engaging the wire during longitudinal advancement there of to displace the same laterally and thus to create and control "pitch" in the coiling of a spring. The pitch tool is also mounted for movement along an "axis" and in a direction generally perpendicular to the line of wire advancement. A servo motor is provided for controlling the movement of the pitch tool under the control of a microprocessor or the like.

The coiling tool is also mounted for movement in two directions generally perpendicular to each other and both generally perpendicular to the wire feed line. Two (2) additional servo motors are provided for respectively controlling coiling tool movement along each "axis" perpendicular to the wire feed line.

Still another feature adding to the flexibility of the spring coiling machine is an auxiliary arbor which is moveable between inoperative and operative positions in a direction generally perpendicular to but displaced slightly in a lateral direction from the line of wire feed movement. The arbor is disposed in an operative position adjacent to and on one side of a portion of wire residing along the line of wire feed and provides lateral resistance, or may be said to act as an anvil for bending of the wire portion thereabout by a coiling tool. The latter is disposed on an opposite side of the wire and is moveable laterally across the wire line toward the arbor. A servo motor for moving the arbor between its inoperative and operative positions is provided and is also adapted to move the arbor to a plurality of operative positions along its length. Said positions effect different wire bending operations.

With the auxiliary arbor regarded as a further or seventh "axis" of movement or control, it will be seen that a high degree of flexibility in operation of the coiling machine is achieved.

DESCRIPTION OF PREFERRED EMBODIMENT

In the specification hereinbelow and in the claims which follow, various terminology which is directional, geometrical, and/or spacial in nature such as "longitudinal", "horizontal", "front", "rear", "upwardly", "downwardly", etc. is employed. It is to be understood that such terminology is used for ease of description and in a relative sense only and is not to be taken in any way as a limitation upon the scope of the present invention.

Figure 1:
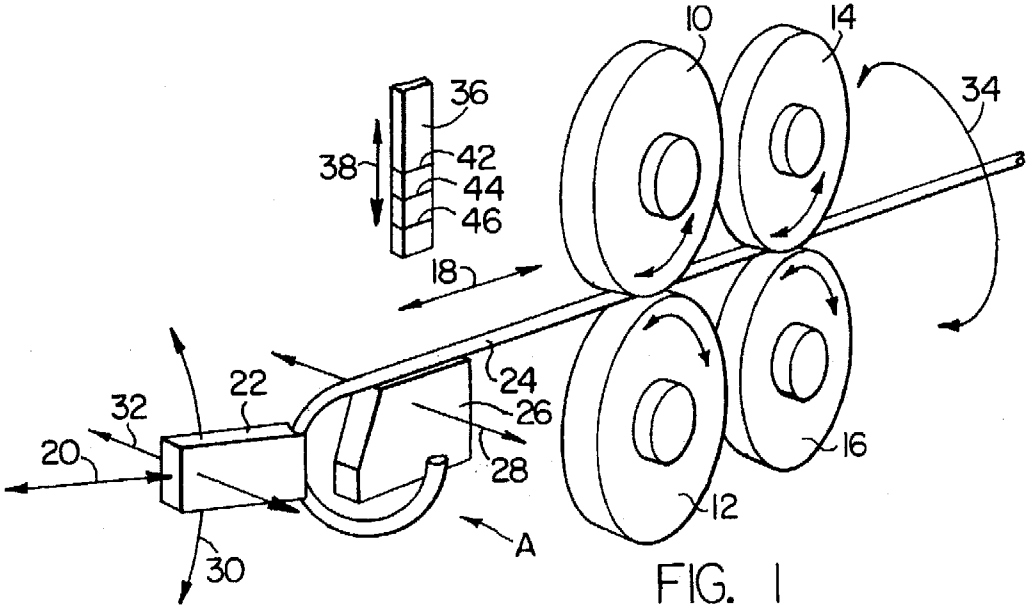
FIG. 1 is a perspective view in schematic form illustrating the improved spring coiling machine of the present invention with arrows indicating control or movement along seven (7) "axes".

Referring now particularly to FIG. 1, it will be observed that a first pair of upper and lower feed rolls 10,12 cooperatively engage wire therebetween and rotate in opposite directions whereby to feed the wire downwardly and leftwardly in FIG. 1. A second pair of feed rolls 14,16 similarly grip wire therebetween and urge the same leftwardly and downwardly toward a coiling station A in FIG. 1. Arrows 18 represent a first "axis" of movement or direction, in this instance the rate of feed or advancement of the wire downwardly and leftwardly in FIG. 1. With the feed rolls 10–16 controlled in their operation by a servo motor under the direction of a microprocessor or the like, the rate of feed or advancement of the wire can of course be varied and controlled as required in the formation of a coil spring or other formed wire article. Further, the wire may be advanced, stopped, perhaps even retracted, and servo controlled in all respects as indicated by the arrows 18 during the formation of the spring or other article.

A second "axis" of control is represented by the arrows 20 associated with coiling tool 22 and, as will be apparent, the axis 20 refers to the movement or positioning of the coiling tool toward and away from wire 24 and, more particularly, substantially along the line of wire feed. As will be seen, the diameter of coil springs formed by the coiling tool 22 may be varied over the length of the spring by appropriate servo controlled movement of the tool along the axis 20. Further, the coiling tool 22 may be moved and controlled along fourth and fifth "axes" as will be described more fully hereinbelow.

Pitch tool 26 which may have a grooved upper surface engaging the wire 24 displaces the same forwardly in FIG. 1 whereby to provide for and control the "pitch" of a coil spring. Arrows 28 represent a third "axis" whereby the pitch tool 26 is mounted for movement in the direction of the arrows, that is, laterally and substantially horizontally relative to the line of wire feed. Movement in the direction indicated by the arrows 28 controlled by a servo motor in turn under the control of a microprocessor or the like, the pitch of a coil spring may for example be varied throughout the length of the spring with different sections of the spring having different pitch characteristics. Other variations in the formation of coil springs and other formed articles are also possible with the precise and accurate servo control of pitch during formation of the spring or other article.

The arrows 30 represent a fourth "axis" of control or movement and, as will be apparent, a shallow substantially vertical arcuate movement is provided for as a convenience in design and construction, vertical linear movement also falling within the scope of the invention. Movement in the direction of the arrows 30 is of course in a lateral or perpendicular direction with respect to the line of wire feed and also with respect to the axis of a coil spring formed at the coiling station A. The movement indicated is employed in the formation of torsion springs and other formed wire articles.

Arrows 32 represent a second perpendicular movement of the coiling tool which, in the case of coil spring formation, is substantially parallel with the axis of the spring. Such movement may be regarded as a fifth "axis" under servo motor control and may be employed in the formation of coil springs having particular end or tail formations and other formed wire articles.

Arrows 34 represent a sixth "axis" of control and, more specifically, rotation of the feed roll assembly as mentioned above with the wire 24 being rotated thereby. Rotation may occur in one and opposite directions about the axis of the wire during formation of a coil spring or other article, and rotation may also be stopped, started, reversed, etc. Control of such operation is exercised by the aforementioned servo motor carried by the feed roll assembly and a microprocessor or the like operatively associated with the servo motor. "Reverse" or "double bodied" torsion springs and other formed articles can be formed with the aid of rotation of the wire feed assembly about the axis of the wire.

Figure 1A:
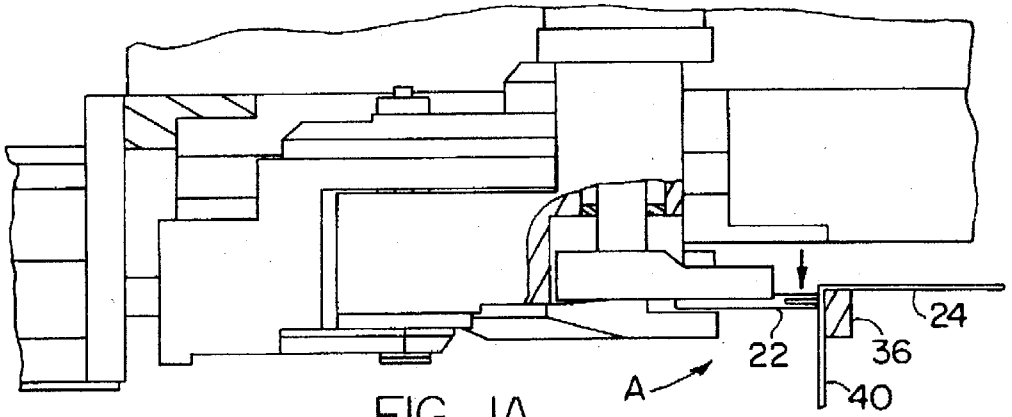
FIG. 1A is a fragmentary schematic view illustrating operation of the auxiliary arbor of the spring coiling machine.

Auxiliary arbor 36, moveable vertically as indicated by arrows 38, represents a seventh "axis". As better illustrated in FIG. 1A the auxiliary arbor may be moved downwardly into position laterally adjacent wire 24 and in front of the wire relative to the line of wire feed. Thereafter, coiling tool 22, having been retracted laterally rearwardly to allow a leading end portion 40 of the wire to be advanced, may be moved forwardly engaging the wire portion 40 and employing the arbor 36 as an anvil in bending the wire portion thereabout. The arbor 36 is moved upwardly and downwardly between operative and inoperative positions by an associated servo motor and has a plurality of operative positions indicated respectively at 42, 44, and 46 along the length thereof. Thus, a sharp right hand bend may be provided for example as illustrated in FIG. 1A with perhaps a shallow 45° bend at position 44 or a bend on a substantial radius at the position 46. The auxiliary arbor may be employed, for example, in the formation of coil springs and other formed articles having specific bending requirements at end or tail portions.

Figure 2:
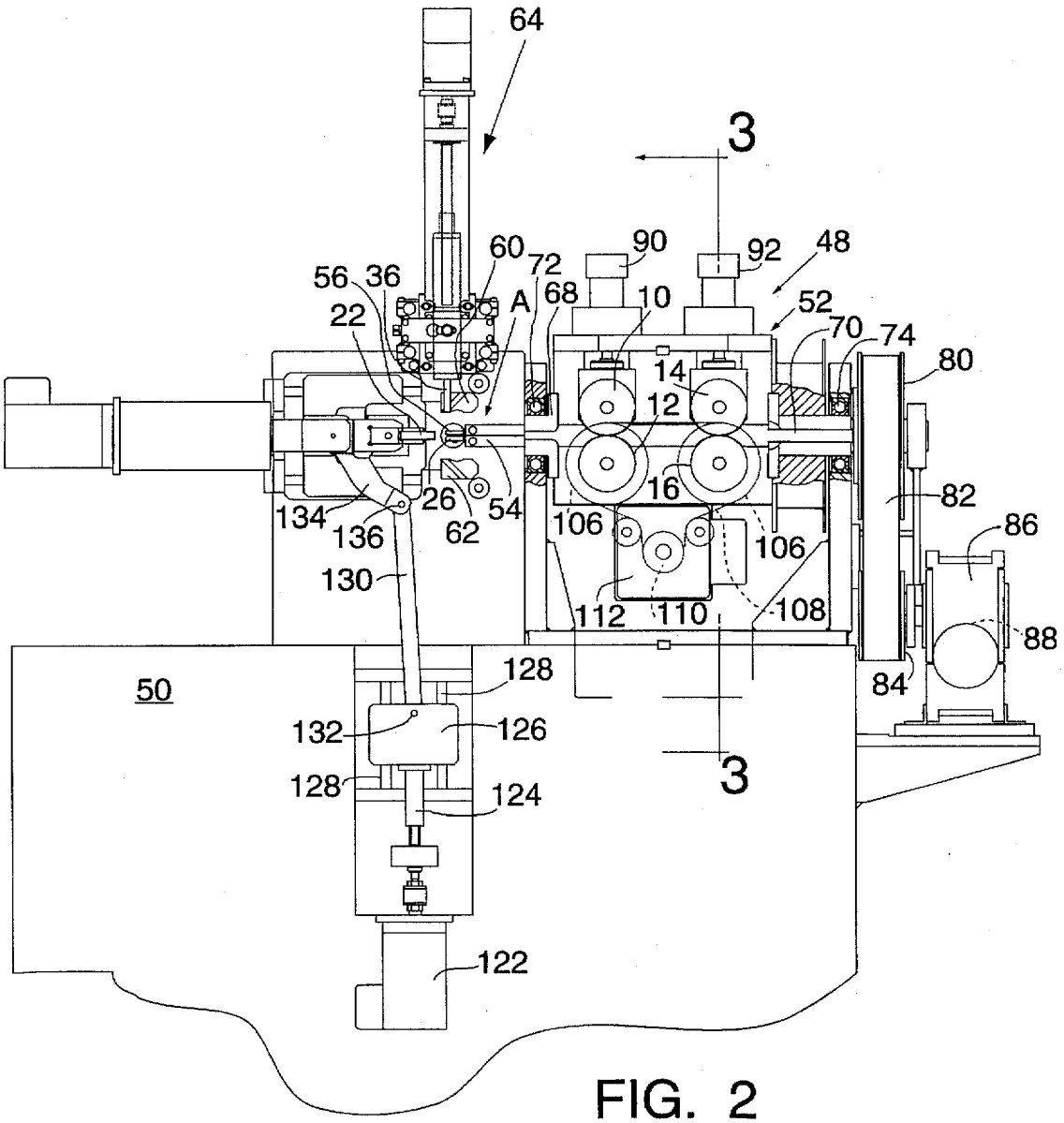
FIG. 2 is an enlarged fragmentary front view of the spring coiling machine of the invention showing a coiling station, feed and guide means, a coiling tool, a pitch tool, and various other tools and servo motors therefore.

Referring now particularly to FIG. 2, it will be observed that a spring coiling machine indicated generally at 48 comprises an upstanding main supporting frame or housing 50. At a front and right hand portion of the frame or housing 50, a feed assembly 52 is provided for intermittently advancing spring wire in a horizontal and longitudinal direction, leftwardly in FIG. 2. The feed assembly 52 includes conventional feed rolls 10, 12, 14,16 with the wire passing first through the rolls and then through a conventional guide means 54 to the coiling station A. At the coiling station A a small arbor 56, which may form a part of the pitch tool 26, may be provided and projects laterally and generally horizontally forwardly so as to be engaged laterally by the wire which is advanced longitudinally leftwardly through the guide means 54 by the feed rolls 10–16. Certain coiling machines, however, may not require an arbor and it is within the scope of the present invention to provide an "arborless" coiling machine. When an arbor such as 56 is provided it may be engaged by the wire during coiling of a spring or it may serve only as an anvil during a cut off operation. Thus, the term arbor is used in a broad sense and not in a limiting sense as it may be employed in the trade in a single point coiling operation where the arbor forms a necessary part of the coiling system or geometry during the coiling of springs. As will be apparent, various sizes of arbors may be provided and adjustment of arbor position for coiling and or cut off may be provided for in a conventional manner.

Coiling tool 22 is positioned along the line of wire feed so as to be engaged by the wire as it advances leftwardly and serves to cause the wire to be coiled in a conventional mariner as described above. Movement of the coiling tool 22 along the various axes mentioned above is provided for by associated servo motor mechanisms which will be described further hereinbelow.

Upper and lower cut off tools 60,62 at the coiling station A may be conventional in construction and operation and, as will be apparent, the tools can be swung toward and away from the arbor 56 for severing a spring from an end portion of the wire after formation of the same. Left and right hand springs and a wide variety of formed articles can be accommodated by the cut off tools.

As mentioned above, pitch tool 26 is also provided at the coiling station A and may be conventional in construction and operation. The pitch tool engages the wire laterally in a grooved portion as mentioned and displaces the wire laterally whereby to "pitch" the spring. Movement of the pitch tool horizontally toward and away from the viewer in FIG. 2 is provided for as mentioned above by an associated servo motor mechanism described more fully hereinbelow.

In addition to the aforementioned more or less conventional tooling at the coiling station A, there is provided an auxiliary arbor mechanism as indicated generally at 64. An arbor 36 is moveable vertically in FIG. 2 between operative and inoperative positions, with the retracted or inoperative position shown in FIG. 2. In its operative position as better illustrated in FIG. 1A, the arbor cooperates with the coiling tool 22 in a wire bending operation as described above.

Figure 3:
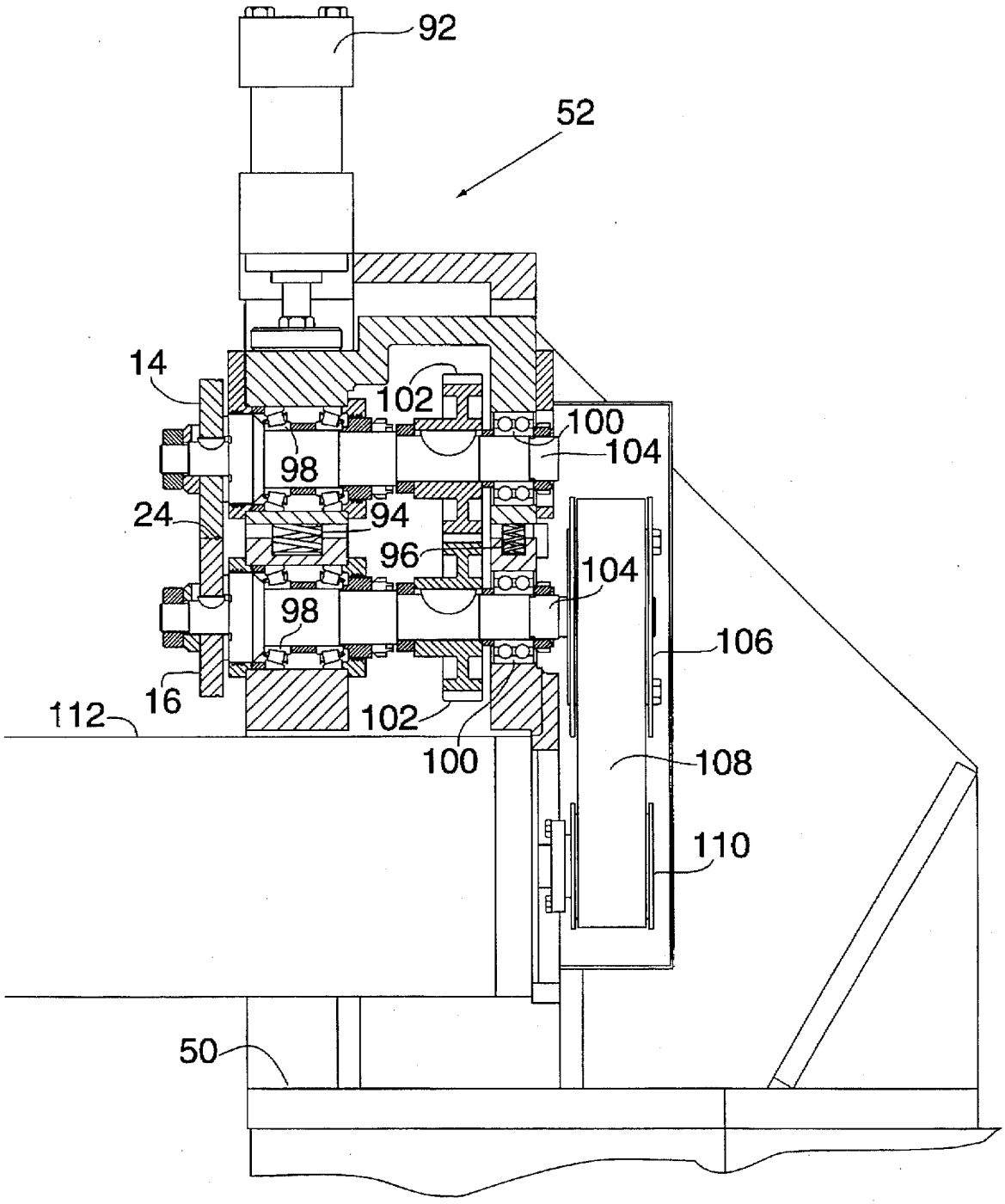
FIG. 3 is an enlarged fragmentary sectional view taken generally as indicated at 3,3 in FIG. 2 and showing a feed roll assembly constructed in accordance with the present invention.
Figure 4:
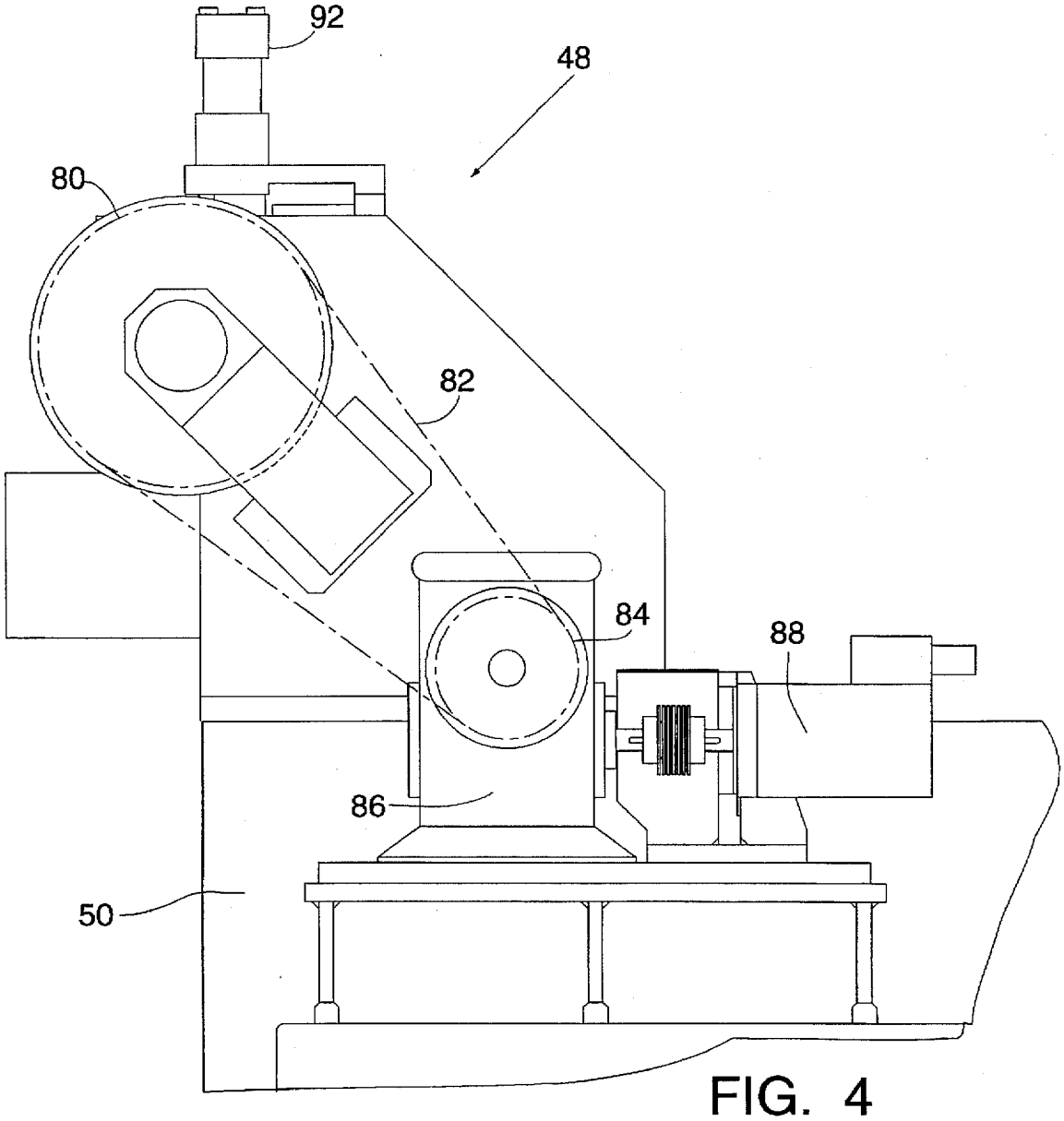
FIG. 4 is an enlarged fragmentary end view of the feed roll assembly and drive means for rotating the same.

Referring now to FIGS. 2, 3, and 4, it will be observed that the feed assembly 52 is supported by hollow stub shafts 68 and 70 respectively at left and right hand end portions in FIG. 2 and journaled in bearings 72,74 for rotation of the assembly. The right hand stub shaft 70 is driven by a pulley 80, FIGS. 2 and 4 in turn driven by a cog belt 82 or the like extending from a smaller pulley 84. The pulley 84 is driven through a speed reducer 86 from a servo motor 88, FIG. 4. Thus, the feed assembly may be rotated preferably in one direction and another from a midpoint through 180° with the servo motor operating under the control of a microprocessor or the like.

Referring particularly to FIGS. 2 and 3, it will be observed that fluid cylinder means 90 and 92 are provided in association with the first and second pair of feed rolls 10, 12, and 14, 16, respectively. As better illustrated in FIG. 3 back-up springs 94,96 are provided for urging the feed rolls relatively apart while the fluid cylinder means, hydraulic cylinders in preferred form, urge the feed rolls together to grip wire 24 therebetween. As will be apparent, the fluid cylinders 90,92 may be operated selectively to cause the feed rolls to grip and release wire as required in a wire feeding operation.

Each of the feed rolls 14 and 16 shown in FIG. 3 has front and rear bearings respectively at 98 and 100 with a gear 102 fixedly mounted on and driving a feed roll shaft 104. The feed rolls 10,12 are provided with similar drive shafts journaled at front and rear bearings and with gears fixedly mounted thereon as with the gears 102,102. Lowermost drive shafts 104,104 associated respectively with feed rolls 12 and 16, as best illustrated in FIG. 2, are driven by pulleys 106,106 and an associated cog belt 108. The cog belt 108 is in turn driven by a pulley 110 under the control of a servo motor 112. The servo motor 112 is supported by and rotates with the feed assembly and as a part thereof. Similarly, the various pulleys 106 and 110 and the cog belt 108 rotate with and as a part of the feed assembly.

As a result of mounting the servo motor on and as a part of the feed assembly for rotation therewith, the necessity for stationary external drive means and power transmission through ring gears etc. is obviated. Fast response, accurate and efficient operation of the rotary feed assembly is thus enhanced.

Figure 5:
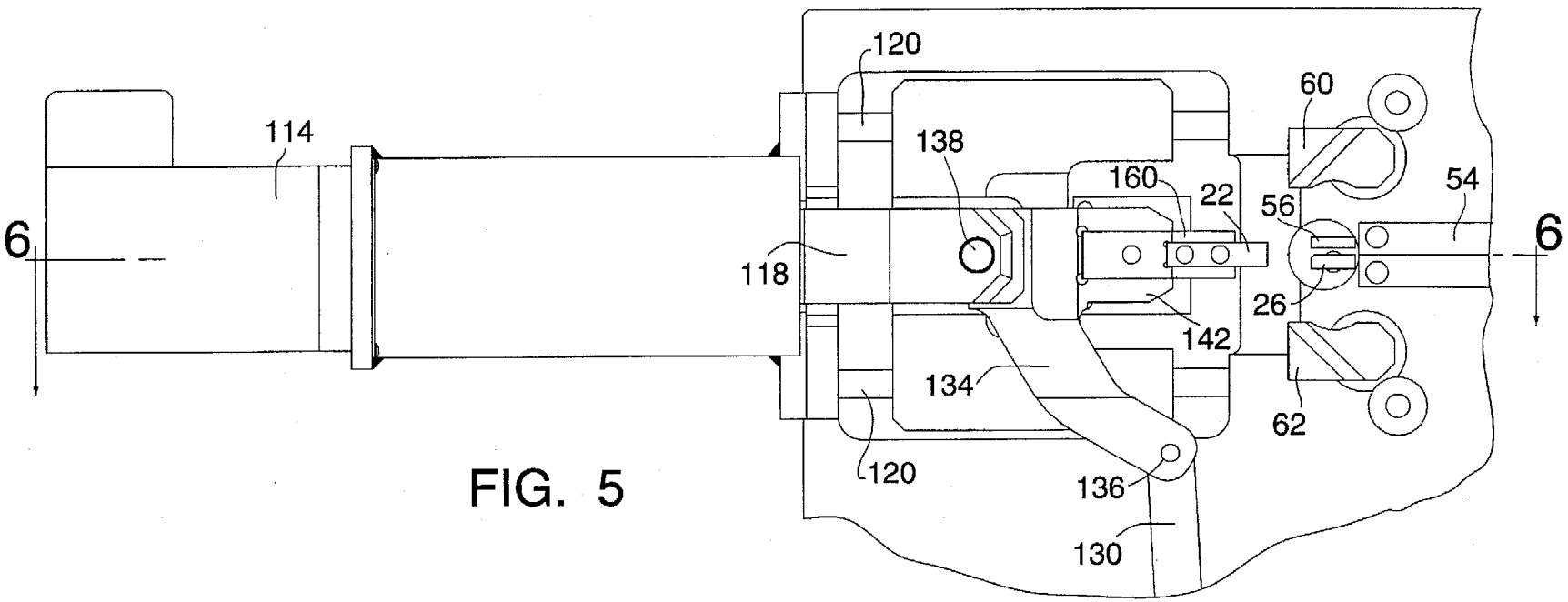
FIG. 5 is an enlarged fragmentary front view showing a coiling tool and operating means therefore including a servo motor for controlling the movement and position of the same along the line of wire feed.
Figure 6:
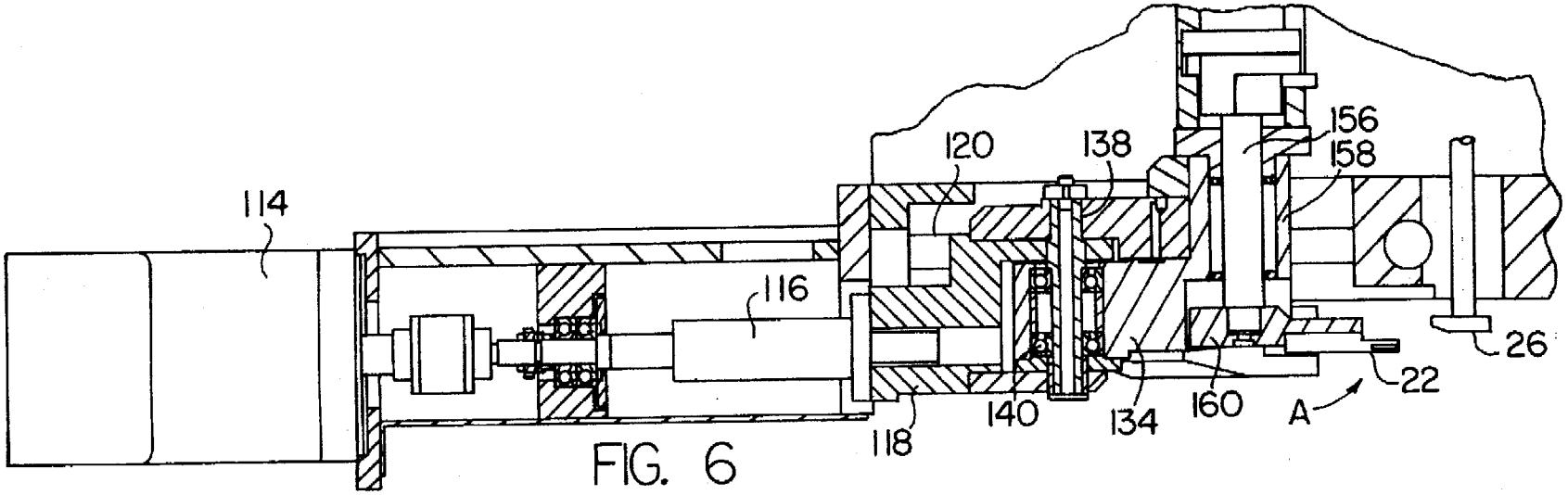
FIG. 6 is an enlarged fragmentary sectional view taken generally as indicated at 6,6 in FIG. 5 and showing the servo motor and associated elements controlling the position of the coiling tool along the line of wire feed together with portions of mechanism for moving the coiling tool in two (2) additional directions perpendicular to the line of wire feed.
Figure 7:
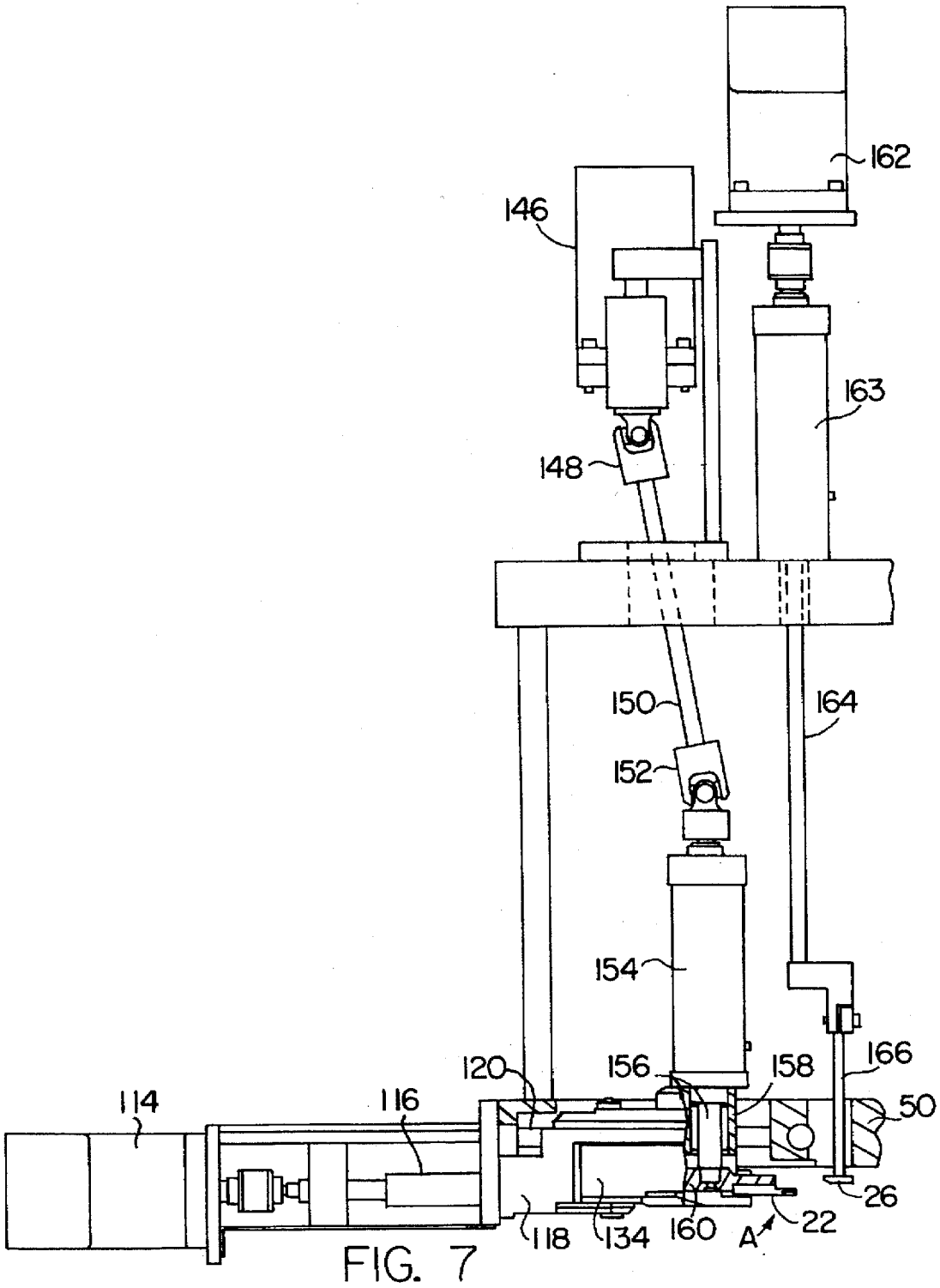
FIG. 7 is fragmentary enlarged view partially in section showing the servo motors and associated elements for controlling the movement and position of the coiling tool along one line of perpendicular movement and the pitch tool.

In FIGS. 5, 6 and 7 mechanism for moving and controlling operation of the coiling tool 22 is illustrated. Referring first to FIG. 6, servo motor 114 drives the input side of a preloaded ball screw mechanism 116 which converts from rotary to linear movement and which in turn drives a slide 118 mounted on guide rods 120, one shown. The coiling tool 22 is thus moveable leftwardly and rightwardly in FIG. 6 on similar movement of the slide 118 in a direction substantially along the line of wire feed. In this manner, second "axis" movement and control is provided for as described above with reference to FIG. 1.

Reverting now to FIG. 2, it will be observed that a servo motor 122 drives a preloaded ball screw mechanism 124 in turn driving a slide 126 on guide rods 128. The slide 126 carries a lever 130 pivotally connected thereto at 132 and with an opposite end portion pivotally connected to an arm 134 at 136. The arm 134 extends to and is mounted on a pivot pin 138, FIGS. 5 and 6. The pivot pin 138 is in turn carried by the slide 118 with bearings 140 providing for free pivotal movement of the arm 134 thereabout. At a forward end portion 142 the arm 134 carries the coiling tool 22.

As will be apparent, operation of the servo motor 122 will result in conversion of rotary to linear motion by the preloaded ball screw mechanism 124, movement of the slide 126 and resulting movement of the lever 130 and the arm 134 in one and an opposite direction. Thus, arcuate movement as indicated by the arrows 30 in FIG. 1 will result with the coiling tool being swung upwardly or downwardly in a vertical plane and in a direction generally perpendicular to the line of wire feed. This fourth "axis" movement is commonly referred to as a torsion "axis" and can be employed in the manufacture of torsion springs as well as a wide variety of other formed wire articles.

Fifth "axis" movement and control is provided for by a servo motor 146 mounted rearwardly of the coiling machine and having a universal connection at 148 with a shaft 150 which also has a universal connection 152 with a preloaded ball screw mechanism 154. Linear output element 156 of the ball screw mechanism 154 is mounted for front to rear lateral sliding movement within a guide member 158, FIGS. 6 and 7. At a front end portion, the member 156 has a coiling tool holder 160 fixedly supported thereon with the latter in turn supporting the coiling tool 22.

As will be apparent, the servo motor 146 may be operated to in turn operate the shaft 150, the ball screw mechanism 154 and the drive element 156 in turn moving the coiling tool 22 forwardly and rearwardly in FIGS. 6 and 7 as required for "lateral coiling point" or fifth "axis" movement and control. The direction of movement is perpendicular to the line of wire feed and also substantially perpendicular to the aforementioned fourth "axis" or torsion movement. Coordination of fourth and fifth axis movement is provided for and is of course accommodated by the shaft 150 and the associated universal joints 148 and 152.

Referring to FIG. 7 a servo motor 162 is also provided at a rear portion of the coiling machine behind the frame 50 and has an associated ball screw mechanism 163. The mechanism 163 in turn operates a linearly moveable rod 164 adjustably connected with a second rod 166 which carries the aforementioned pitch tool 26 at a front end portion thereof.

As will be apparent, the aforementioned third axis movement is achieved by the servo motor 162, the conversion mechanism 163, and rods 164,166 to provide for the required lateral movement of the pitch tool 26 as described above.

Figure 8:
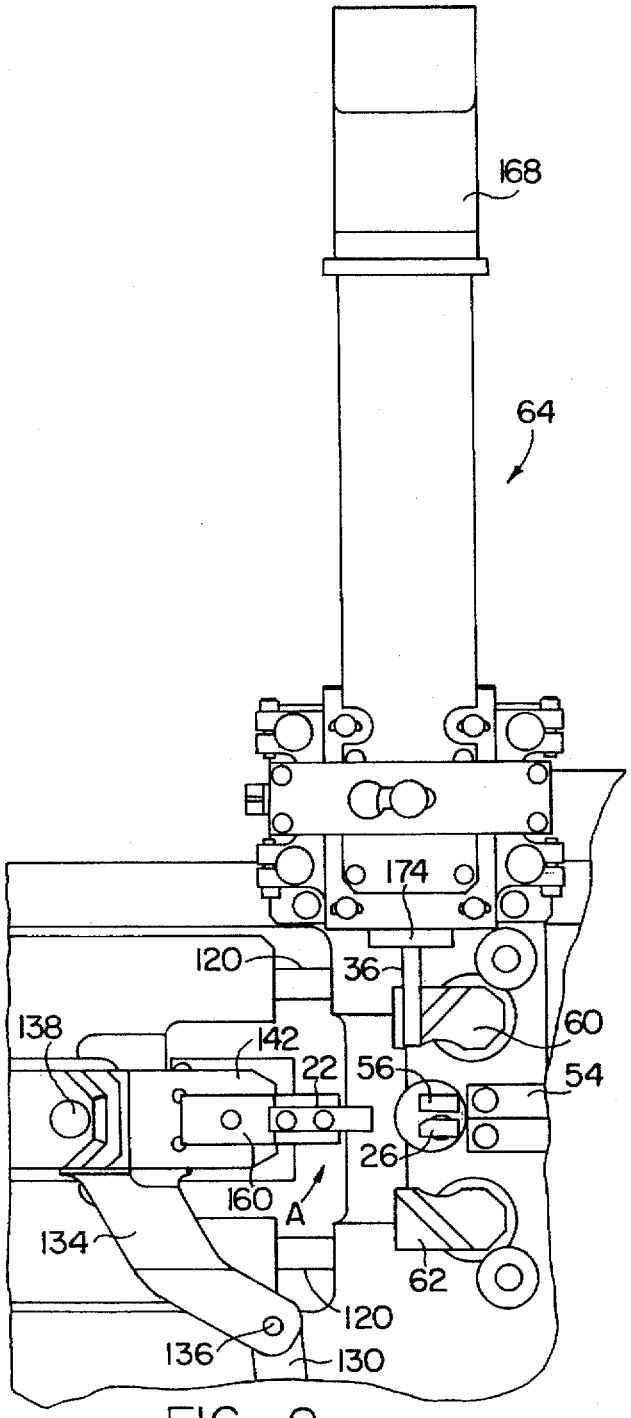
FIG. 8 is an enlarged fragmentary front view showing an auxiliary arbor at a coiling station in relation to a coiling tool.
Figure 9:
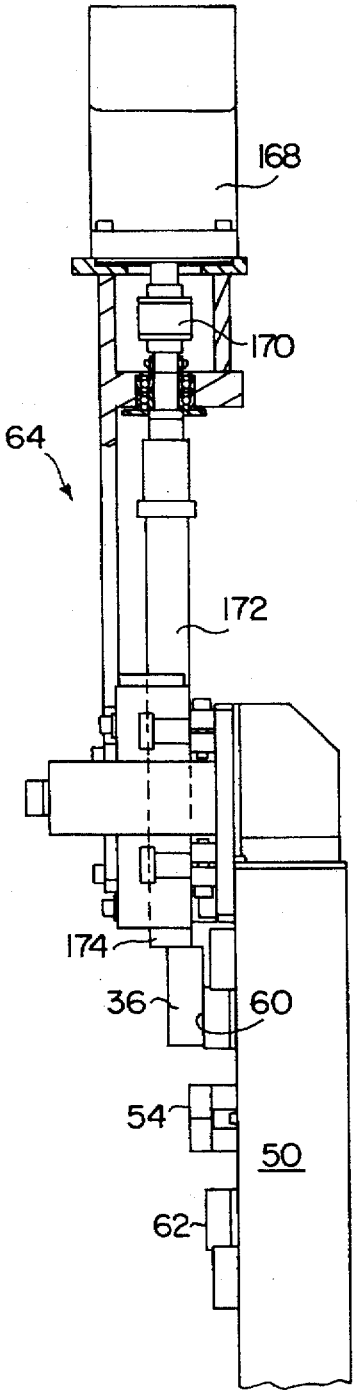
FIG. 9 is an enlarged fragmentary side elevational view showing the auxiliary arbor.

The seventh "axis" movement and/or control of auxiliary arbor 36 is illustrated in FIGS. 8 and 9. Arbor 36 is moveable vertically relative to the various tooling and the wire at the coiling station A as described above. Servo motor 168 has an associated coupling 170 and a preloaded ball screw mechanism 172 for conversion from rotary to linear movement. An output member 174 of the mechanism 172 carries the auxiliary arbor 36 and moves the same from the elevated inoperative position shown in FIGS. 8 and 9 to its lower operative position in FIG. 1A laterally adjacent a portion of wire at the coiling station. The several operating positions 42, 44, 46 along the length of the arbor 36 are effected by the servo motor as required under the control of an associated microprocessor for the provision of desired bending operations.

Figure 10:
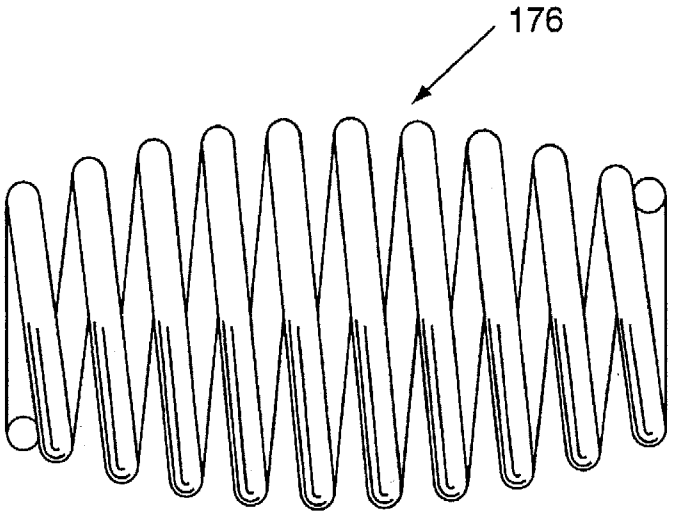
FIG. 10 illustrates a "barrel" type coil spring formed with second axis control.

FIG. 10 illustrates a coil spring 176 employing the second axis movement and control wherein the diameter tool may be slightly withdrawn and then returned to an original position in the formation of a "barrel" coil spring.

Figure 11:
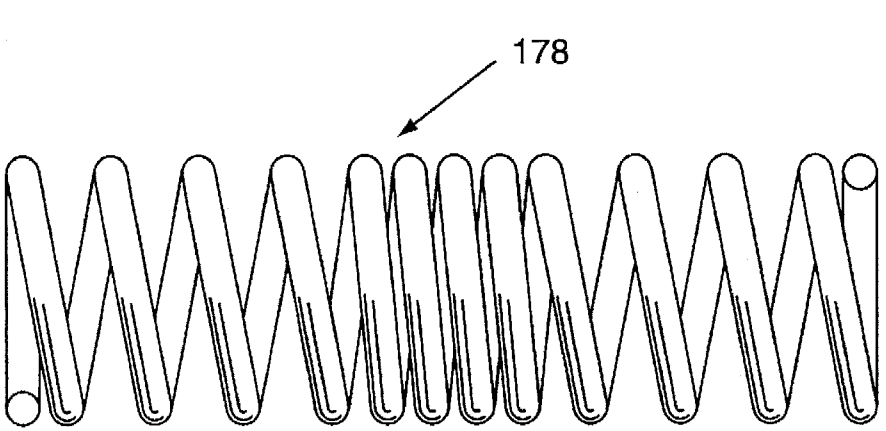
FIG. 11 illustrates a variable pitch coil spring formed with third axis control.

FIG. 11 illustrates the third axis of movement and control wherein a pitch tool initially provides a rather coarse pitch followed by a fine pitch at an intermediate portion of a spring 178 and another coarse pitch section at an end portion of the spring formation.

Figure 12B:
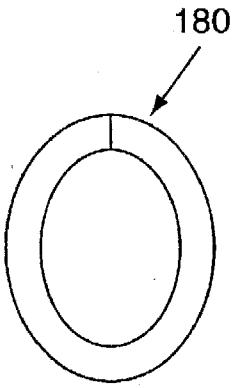
FIGS. 12A and 12B illustrate a variable pitch coil spring formed with third axis control and also with second axis or diameter control resulting in an oval coil configuration.
Figure 12A:
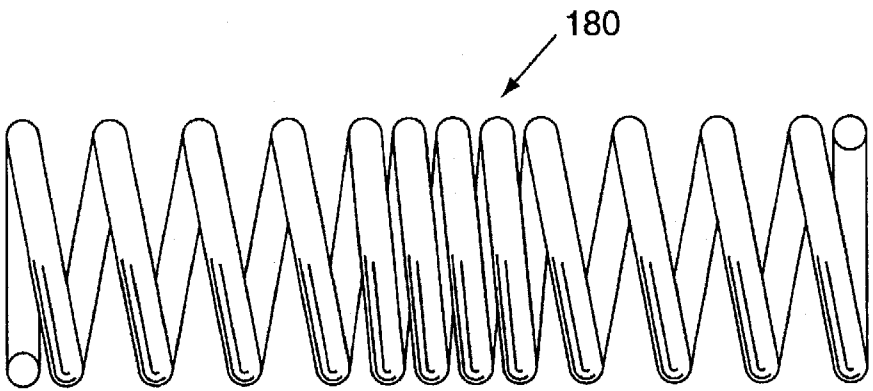

FIG. 12A shows a spring 180 similar to the spring 178 employing the third axis of control for variable pitch and also employing the second axis control with the diameter tool being moved as required during the formation of each coil of the spring to provide an oval configuration thereof.

FIGS. 13A through 15B illustrate springs formed with the four axes capability of the coiling machine. Thus FIGS. 13A and B illustrate a torsion spring 182 wherein the fourth axis is employed.

Figure 14B:
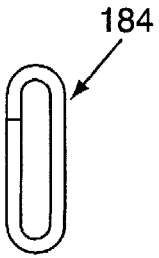
FIGS. 14A and 14B illustrate a coil spring formed with a linear side portions on each coil employing the fourth axis or torsion control.
Figure 14A:
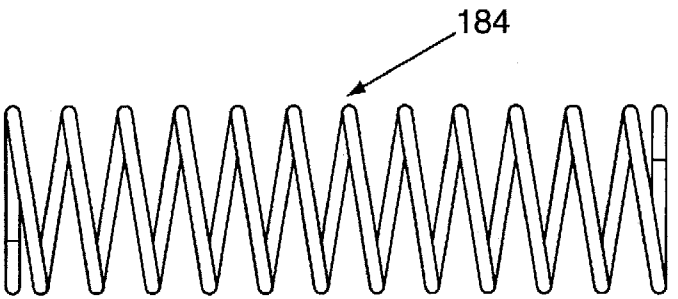
Figure 15B:
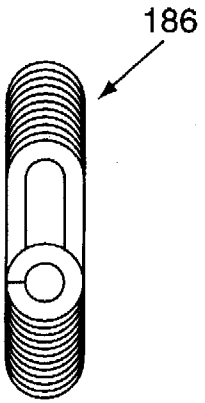
FIGS. 15A and 15B illustrate a tapered coil spring employing second axis diameter control and also employing fourth axis control resulting in linear opposing side sections of the spring.
Figure 15A:
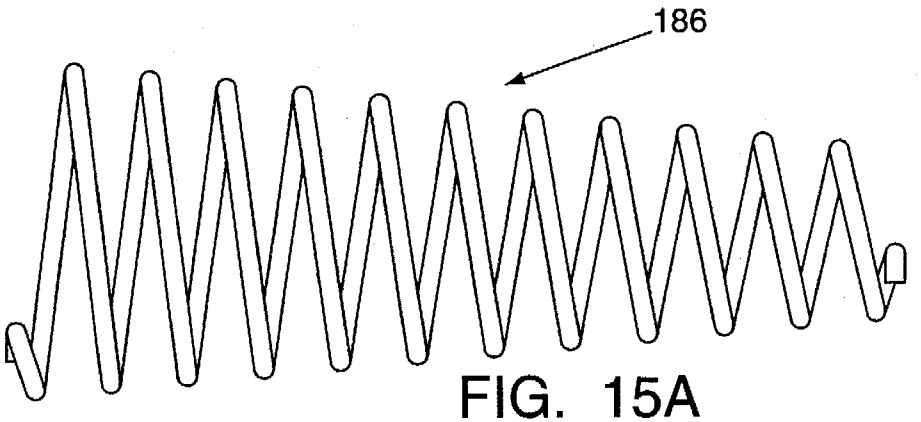
Figure 13A:
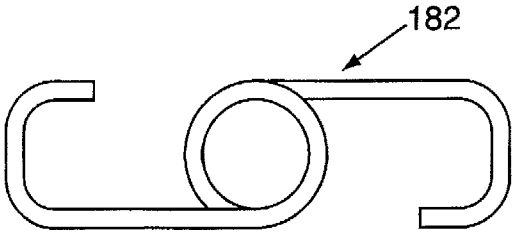
FIG. 13A and 13B illustrates a torsion spring.
Figure 13B:
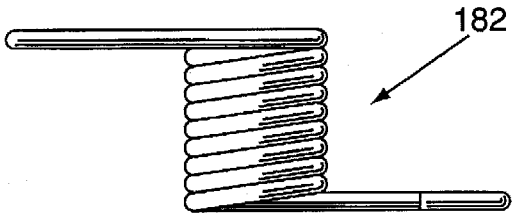

FIGS. 14A and 14B include spring 184 wherein linear opposite side portions of the spring are formed with the aid of the fourth axis control and FIGS. 15A and 15B show a tapered spring 186 formed with both second and fourth axis control the diameter varying from one end of the spring to the other and the straight side sections of the spring being formed with the aid of fourth axis control.

In FIGS. 16A through 17B five axes springs are illustrated wherein the lateral movement or filch axis of the coiling tool is employed particularly in the formation of the bent end portions thereof.

Figure 18A:
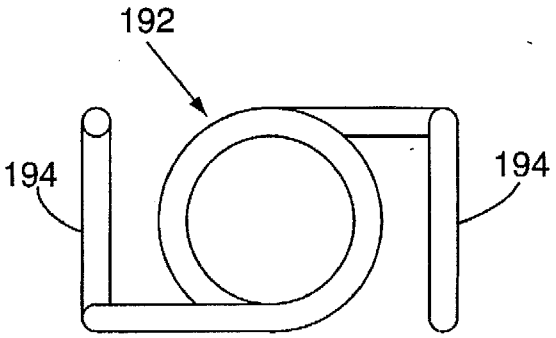
FIGS. 18A and 18B illustrate a torsion spring employing fourth axis control and also employing seventh axis control in the specific bending of end or tail portions of the spring.
Figure 18B:
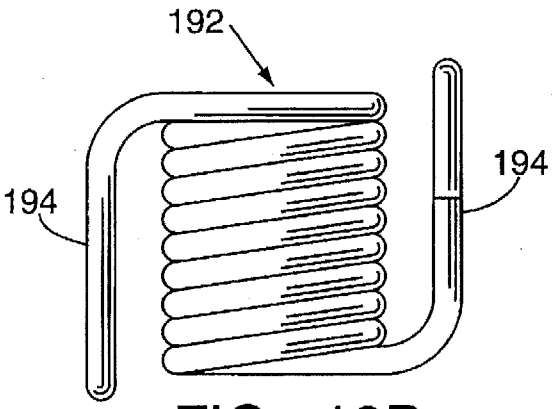
Figure 17A:
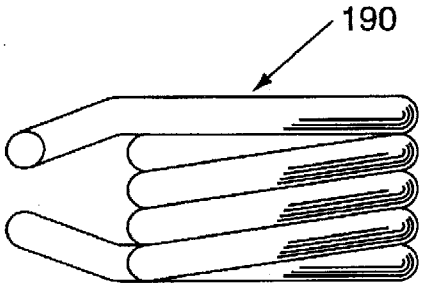
FIGS. 17A and 17B illustrate another fore of a coil spring employing seventh axis control in the bending of end or tail portions of the spring.
Figure 17B:
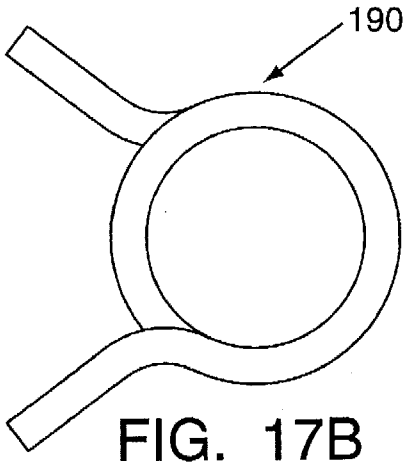
Figure 16A:
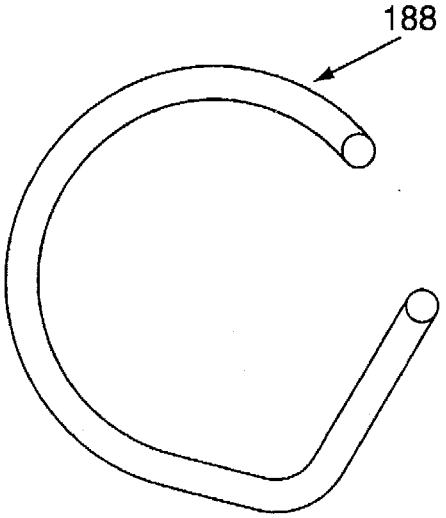
FIGS. 16A and 16B illustrate a single coil spring employing seventh axis movement and control in the bending of end portions of the spring.
Figure 16B:
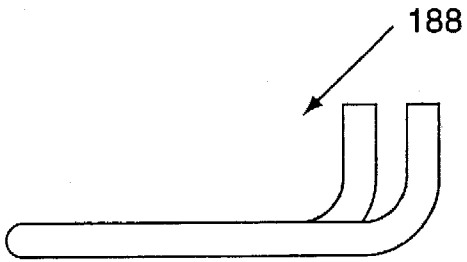
Figure 19B:
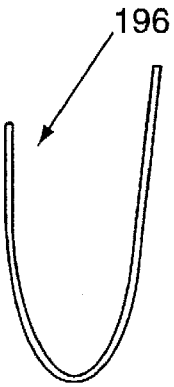
FIGS. 19A and 19B respectively show front and side views of a wire form provided with the coiling machine of the present invention.
Figure 19A:
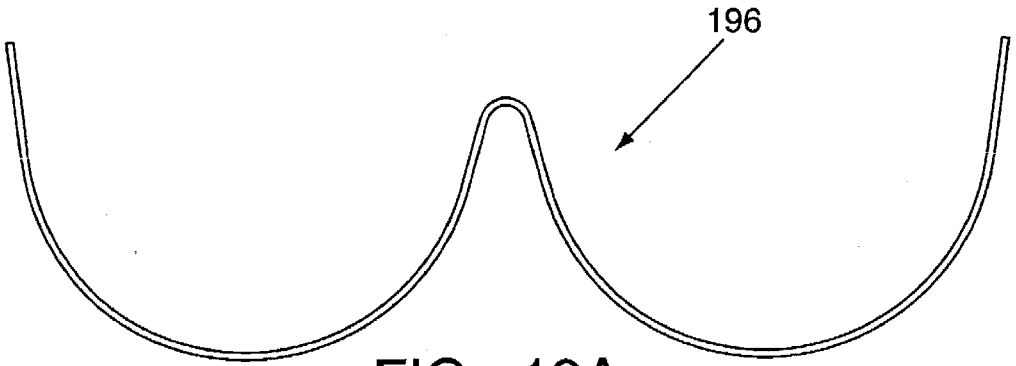

FIGS. 18A and 18B show similar spring formations with final bending of the end portions at 194,194 being accomplished with the seventh or auxiliary arbor axis.

FIGS. 19A–20B illustrate various formed wire products other than springs which are readily provided with the improved spring coiling machine of the present invention. As with the preceding spring formations it is merely necessary to enter a desired program in a microprocessor or other control for operation the various servo motors of the machine in order to provide wire formed products such as those at 196 and 198.

Figure 21B:
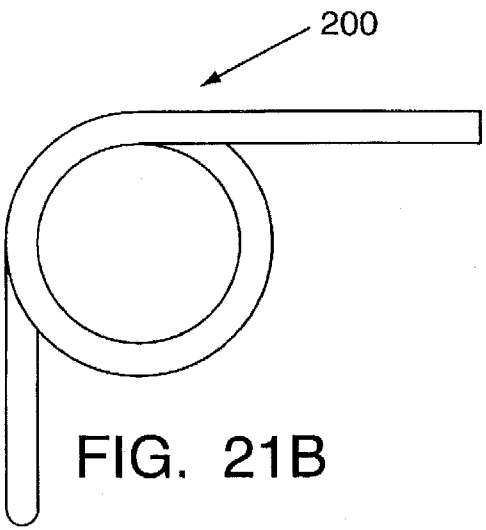
FIG. 21A and 21B illustrate a double torsion spring formed with sixth axis control.
Figure 21A:
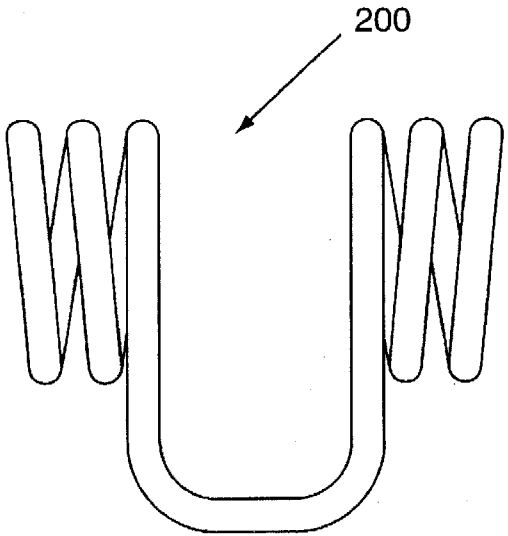
Figure 20B:
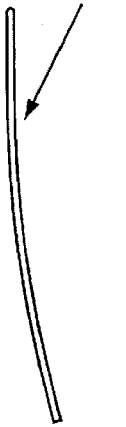
FIGS. 20A and 20B respectively show front and side views of another wire form provided with the improved and highly flexible coiling machine of the present invention.
Figure 20A:
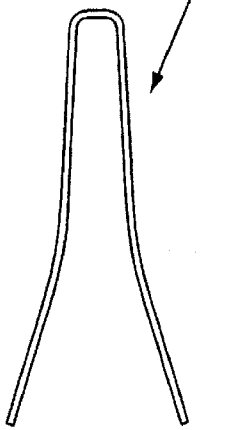

FIGS. 21A and B illustrate a double torsion spring formed with the sixth axis or rotary feed control.

From the foregoing it will be apparent that a high degree of flexibility has been provided for in the improved spring coiling machine of the present invention. A multitude of spring configurations and wire forms can be manufactured with almost insignificant set-up time merely by selecting the desired program. Operation of the machine exceeds prior art machines in speed, efficiency and accuracy.

We claim:

1. In a cyclically operable spring coiling machine having a coiling station, a feed roll assembly comprising at least one pair of oppositely rotatable feed rolls for cooperatively gripping wire therebetween and for advancing the same longitudinally to the coiling station, at least one coiling tool at the coiling station arranged to engage longitudinally advancing wire and to obstruct the linear movement thereof whereby progressively to bend the same and to thus impart a coiling stress thereto resulting in the formation of a coil spring at a leading end portion thereof, at least one cut-off tool at said coiling station and operable intermittently to sever coiled leading end portions of the wire whereby to provide individual coil springs;

the improvement comprising mounting the feed roll assembly for rotation through substantially 360° in one and opposite directions from a mid point through substantially 180° about the axis of wire advanced by the feed rolls, providing a servo motor for rotating at least one of the feed rolls and which is supported by, rotatable with, and forms a part of the feed roll assembly, and providing a stationary servo motor for bodily rotating the feed roll assembly including the aforesaid feed roll servo motor in timed relationship with the advancement of wire and the formation of coil springs.

2. A cyclically operable spring coiling machine as set forth in claim 1 including a fluid cylinder means in operative association with at least one of said feed rolls for urging the same in a direction generally perpendicular to the line of wire feed and toward the other feed roll, said fluid cylinder means being operable selectively to cause the feed rolls to grip and release wire extending therebetween and being supported by and rotatable with the feed roll assembly.

3. A cyclically operable spring coiling machine as set forth in claim 1 and including a pitch tool at the coiling station engageable with and operable during longitudinal wire advancement to displace the wire laterally, said pitch tool being mounted for movement in a direction generally perpendicular to the line of wire advancement, and also including a servo motor for controlling the movement of said pitch tool.

4. A cyclically operable spring coiling machine as set forth in claim 1 and including an auxiliary arbor movable between inoperative and operative positions in a direction generally perpendicular to but displaced slightly in a lateral direction from the line of wire feed movement, the arbor being disposed in an operative position adjacent to and on one side of a portion of wire residing along the line of wire feed movement, and the arbor thus providing lateral resistance for bending of the wire portion thereabout by a coiling tool disposed on an opposite side of the wire and moveable laterally across the wire line toward the arbor, and also including a servo motor for moving the arbor between its inoperative and operative positions.

5. A cyclically operable spring coiling machine as set forth in claim 2 wherein two (2) pairs of feed rolls are provided in adjacent relationship with at least one roll of each pair driven by said servo motor and with at least one roll of each pair having an associated fluid cylinder means for urging the same in a generally perpendicular direction relative to the line of wire feed for gripping and releasing wire.

6. A cyclically operable spring coiling machine as set forth in claim 5 wherein a gear means is provided to be driven by the servo motor and to in turn drive all four feed rolls in unison with opposing feed rolls rotating in opposite directions.

7. A cyclically operable spring coiling machine as set forth in claim 6 wherein at least one guide means is provided in said feed roll assembly for passage of the wire therethrough in association with said feed rolls.

8. A cyclically operable spring coiling machine as set forth in claim 3 wherein said coiling tool is also mounted for movement in a direction generally perpendicular to said wire feed line, and wherein another servo motor is provided for controlling movement of the coiling tool in the generally perpendicular direction relative to said wire feed line.

9. A cyclically operable spring coiling machine as set forth in claim 8 wherein said coiling tool is mounted for movement in two directions generally perpendicular to each other and both generally perpendicular to said wire feed line, and wherein two additional servo motors are provided for controlling movement of the coiling tool generally perpendicularly to said wire feed line respectively in said two directions.

10. A cyclically operable spring coiling machine as set forth in claim 9 wherein said two perpendicular directions of movement of said cooling tool are respectively substantially perpendicular to and parallel with the axis of a coil spring formed at the coiling station.

11. A cyclically operable spring coiling machine as set forth in claim 4 wherein the auxiliary arbor has a plurality of operative positions along its length each with a different wire forming contour, and wherein the servo motor is operable to selectively move the arbor to said positions as required for different wire bending operations.

12. In a wire forming machine having a forming station, a feed roll assembly comprising at least one pair of oppositely rotatable feed rolls for cooperatively gripping wire therebetween and for advancing the same longitudinally to the forming station, at least one forming tool at the forming station arranged to engage longitudinally advancing wire and to progressively form the same to a desired configuration at a leading end portion thereof, at least one cut-off tool at said forming station operable intermittently to sever formed leading end portions of the wire whereby to provide individual formed wire products;

the improvement comprising mounting the feed roll assembly for rotation through substantially 360° about the axis of wire advanced by the feed rolls, providing a servo motor for driving at least one of the feed rolls and which is supported by, rotatable with, and forms a part of the feed roll assembly, and providing a stationary servo motor for bodily rotating the feed roll assembly in timed relationship with the advancement of the wire and the forming of the wire.

13. A wire forming machine as set forth in claim 12 wherein the feed roll assembly is rotatable in one and an opposite and in both directions from a mid point through substantially 180°.

14. A wire forming machine as set forth in claim 12 including a fluid cylinder means in operative association with at least one of said feed rolls for urging the same in a direction generally perpendicular to the line of wire feed and toward the other feed roll, said fluid cylinder means being operable selectively to cause the feed rolls to grip and release wire extending therebetween and being supported by and rotatable with the feed roll assembly.

15. A wire forming machine as set forth in claim 14 wherein two (2) pairs of feed rolls are provided in adjacent relationship with at least one roll of each pair driven by said servo motor and with at least one roll of each pair having an associated fluid cylinder means for urging the same in a generally perpendicular direction relative to the line of wire feed for gripping and releasing wire.

16. A wire forming machine as set forth in claim 15 wherein a gear means is provided to be driven by the servo motor and to in turn drive all four feed rolls in unison with opposing feed rolls rotating in opposite directions.

17. A wire forming machine as set forth in claim 16 wherein at least one guide means is provided on said feed roll assembly for passage of the wire therethrough in association with said feed rolls.

18. In a cyclically operable spring coiling machine having a coiling station; the combination of a feed roll assembly comprising at least one pair of oppositely rotatable feed rolls for cooperatively gripping wire therebetween and for advancing the same longitudinally to the coiling station, at least one coiling tool at the coiling station arranged to engage longitudinally advancing wire and to obstruct the linear movement thereof whereby progressively to bend the same and to thus impart a coiling stress thereto resulting in the formation of a coil spring at a leading end portion thereof, said coiling tool being mounted for movement in one and an opposite direction and substantially along the wire feed line and also for movement in a direction generally perpendicular to said wire feed line and substantially parallel to the axis of a spring coiled at the coiling station, a pair of servo motors respectively for controlling the movement of said coiling tool along and perpendicular to said wire feed line, an auxiliary arbor movable between inoperative and operative positions in direction generally perpendicular to but displaced slightly in a lateral direction from the wire feed line, the arbor being disposed in an operative position adjacent to and on one side of a portion of wire residing along the line of wire feed, and the arbor thus providing lateral resistance for bending of the wire portion thereabout by the coiling tool in a direction substantially parallel to the axis of a spring coiled at the coiling station, the coiling tool being disposed on an opposite side of the wire and moveable laterally across the wire line toward the arbor, and also including a servo motor for moving the arbor between its inoperative and operative positions, and at least one cut off tool at said coiling station adjacent said coiling arbor and operable intermittently to sever coiled leading end portions of the wire whereby to provide individual coil springs.

19. A cyclically operable spring coiling machine as set forth in claim 18 wherein the auxiliary arbor has a plurality of operative positions each with a different wire forming contour, and wherein the servo motor is operable to selectively move the arbor to said positions as required for different wire bending operations.

20. A cyclically operable spring coiling machine as set forth in claim 19 and including a pitch tool at the coiling station engageable with and operable during longitudinal wire advancement to displace the wire laterally, said pitch tool being mounted for movement in a direction generally perpendicular to the line of wire advancement, and also including a servo motor for controlling the movement of said pitch tool.

21. A cyclically operable spring coiling machine as set forth in claim 20 wherein said coiling tool is mounted for movement in two directions generally perpendicular to each other and both generally perpendicular to said wire feed line, and wherein two additional servo motors are provided for controlling movement of the coiling tool generally perpendicularly to said wire feed line respectively in said two directions.

22. A cyclically operable spring coiling machine as set forth in claim 21 wherein said two perpendicular directions of movement of said cooling tool are respectively substantially perpendicular to and parallel with the axis of a coil spring formed at the coiling station.

23. A cyclically operable spring coiling machine as set forth in claim 22 wherein the feed roll assembly is mounted for rotation about the axis of wire advanced by the feed rolls, a servo motor is provided for driving at least one of the feed rolls and is supported by, rotatable with, and forms a part of the feed roll assembly, and wherein a stationary servo motor is provided for bodily rotating the feed roll assembly in timed relationship with the advancement of wire and the formation of coil springs and the like.

24. A cyclically operable spring coiling machine as set forth in claim 23 wherein two (2) pairs of feed rolls are provided in adjacent relationship with at least one roll of each pair driven by said servo motor and with at least one roll of each pair having an associated fluid cylinder means for urging the same in a generally perpendicular direction relative to the line of wire feed for gripping and releasing wire.

25. A cyclically operable spring coiling machine as set forth in claim 24 wherein a gear means is provided to be driven by the servo motor and to in turn drive all four feed rolls in unison with opposing feed rolls rotating in opposite directions.

26. A cyclically operable spring coiling machine as set forth in claim 25 wherein at least one guide means is provided on said feed roll assembly for passage of the wire therethrough in association with said feed rolls.

27. In a cyclically operable spring coiling machine having a coiling station; the combination of a feed roll assembly comprising at least one pair of oppositely rotatable feed rolls for cooperatively gripping wire therebetween and for advancing the same longitudinally to the coiling station, said feed roll assembly also including a servo motor for rotatably driving at least one of the feed rolls, and said feed roll assembly being mounted for rotation about the axis of wire advanced by the feed rolls, a stationary servo motor for rotating the feed roll assembly in timed relationship with the advancement of wire by the feed rolls, at least one coiling tool at the coiling station arranged to engage longitudinally advancing wire and to obstruct the linear movement thereof whereby progressively to bend the same and thus to impart a coiling stress thereto resulting in the formation of a coil spring at a leading end portion thereof, said coiling tool being mounted for movement generally toward and away from said coiling arbor and substantially along a forwardly extended wire feed line, a servo motor for controlling the movement of said coiling tool, and at least one cut off tool at said coiling station and operable intermittently to sever coiled leading end portions of the wire whereby to provide individual coil springs, a pitch tool at the coiling station engagable with and operable during longitudinal wire advancement to displace the wire laterally, said pitch tool being mounted for movement in a direction generally perpendicular to the line of wire advancement, a servo motor for controlling the movement of said pitch tool;

said coiling tool being mounted for movement in two directions generally perpendicular to each other and both generally perpendicular to said wire feed line and respectively substantially perpendicular to and parallel with the axis of a coil spring formed at the coiling station, and two additional servo motors for controlling movement of the coiling tool generally perpendicularly to said wire feed line respectively in said two directions.

28. A cyclically operable spring coiling machine as set forth in claim 27 wherein the feed roll assembly is rotatable in one and an opposite and in both directions from a mid point through substantially 180°.

29. In a cyclically operable spring coiling machine having a coiling station, a feed roll assembly comprising two (2) pairs of feed rolls in adjacent relationship with at least one roll of each pair having an associated fluid cylinder means for urging the same in a generally perpendicular direction relative to the line of wire feed for gripping and releasing wire, said rolls cooperatively gripping wire therebetween and advancing the same longitudinally to the coiling station, at least one coiling tool at the coiling station arranged to engage longitudinally advancing wire and to obstruct the linear movement thereof whereby progressively to bend the same and to thus impart a coiling stress thereto resulting in the formation of a coil spring at a leading end portion thereof, at least one cut-off tool at said coiling station and operable intermittently to sever coiled leading end portions of the wire whereby to provide individual coil springs;

the improvement comprising mounting the feed roll assembly for rotation in one and opposite directions about the axis of wire advanced by the feed rolls, providing a servo motor for rotating said feed rolls and which is supported by, rotatable with, and forms a part of the feed roll assembly, and providing a stationary servo motor for bodily rotating the feed roll assembly including the aforesaid feed roll servo motor in timed relationship with the advancement of wire and the formation of coil springs.

30. A cyclically operable spring coiling machine as set forth in claim 29 wherein a gear means is provided to be driven by the servo motor and to in turn drive all four feed rolls in unison with opposing feed rolls rotating in opposite directions.

31. A cyclically operable spring coiling machine as set forth in claim 29 wherein at least one guide means is provided on said feed roll assembly for passage of the wire therethrough in association with said feed rolls.

32. A cyclically operable spring coiling machine as set forth in claim 29 wherein said feed roll assembly is rotatable through substantially 360° in said one and opposite directions from a mid point through substantially 180°.

* * * * *